US007477860B2

(12) United States Patent
Hanano

(10) Patent No.: US 7,477,860 B2
(45) Date of Patent: Jan. 13, 2009

(54) IMAGE FORMING APPARATUS WITH AN AIR CHANNEL THAT COMMUNICATES WITH A HANDLE FOR A SHEET CASSETTE

(75) Inventor: Susumu Hanano, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/894,849

(22) Filed: Aug. 22, 2007

(65) Prior Publication Data

US 2008/0050145 A1 Feb. 28, 2008

(30) Foreign Application Priority Data

Aug. 25, 2006 (JP) ..... 2006-228606

(51) Int. Cl.
*G03G 21/20* (2006.01)

(52) U.S. Cl. ..... 399/92

(58) Field of Classification Search ..... 399/92, 399/93, 391, 393, 94, 107
See application file for complete search history.

(56) References Cited

U.S. PATENT DOCUMENTS

2007/0104509 A1* 5/2007 Kabashima ..... 399/124

FOREIGN PATENT DOCUMENTS

JP 2000-3082 1/2000
JP 2003-76253 3/2003

* cited by examiner

*Primary Examiner*—Quana M Grainger
(74) *Attorney, Agent, or Firm*—Gerald E. Hespos; Anthony J. Casella

(57) ABSTRACT

An image forming apparatus includes: an apparatus main bod; a sheet feeding cassette attached to the apparatus main body so as to be pulled out to an outside; a cover that covers, with an internal space in between, a portion of the apparatus main body different from a portion where the sheet feeding cassette is attached; a handle portion formed on a front face side in a pull-out direction of the sheet feeding cassette so as to open for enabling a user to insert a fingertip therein; an air channel formed in the sheet cassette and allowing an opening of the handle portion and the internal space inside the cover to communicate with each other; and an air blower that sends outside air inside the apparatus main body by way of the opening, the air channel, and the internal space.

8 Claims, 11 Drawing Sheets

IMAGE FORMING APPARATUS WITH AN AIR CHANNEL THAT COMMUNICATES WITH A HANDLE FOR A SHEET CASSETTE

BACKGROUND OF THE INVENTION

1. Field of the Invention

The present invention relates to an image forming apparatus, such as a copying machine, a printer, a facsimile machine, and a complex machine of the foregoing.

2. Description of the Related Art

An image forming apparatus 100 as shown in FIG. 11 is conventionally configured so as to cool a heat source, such as the fixing device provided in the interior of an apparatus main body 101, by introducing outside air inside through fine clearances leading to the interior of the apparatus main body 101 and blowing the introduced outside air to the fixing device or the like by an unillustrated fan (air blower). Examples of the fine clearances referred to herein include but not limited to a clearance 103 between the apparatus main body 101 and a front cover 102, a clearance 107 between the apparatus main body 101 and sheet feeding cassettes 104, 105, and 106, clearances 108 and 108 between the sheet feeding cassettes 104 and 105 and between the sheet feeding cassettes 105 and 106, and a clearance 110 between the sheet feeding cassette 104 and the front cover 102.

In the prior art as above, however, the clearances 103, 107, 108 and 110 serving as air intake channels to introduce outside air to the interior of the apparatus main body 101 are too narrow to secure sufficiently large sectional areas of the air intake channels. It is therefore difficult to achieve the cooling effect efficiently by the fan.

Such being the case, there have been developed techniques to provide a louver to the side face of the image forming apparatus for introducing outside air inside (JP-A-2003-76253) and to provide a louver to the front cover of the image forming apparatus for introducing outside air inside (JP-A-2000-3082).

The air intake louver, however, is provided at a position where it is readily visually recognized by the user in the image forming apparatus in these patent documents, which deteriorates the outward appearance. Hence, there has been a need from the market to enhance the quality in outward appearance by providing the air intake louver to a position where it is hardly visually recognized by the user.

In addition, the image forming apparatus disclosed in JP-A-2003-76253 supra is configured in such a manner that the air intake louver opens in the side face. This image forming apparatus therefore has a problem that it cannot be installed with the side face provided with the louver situated next to a wall or an external large volume sheet feeding deck.

SUMMARY OF THE INVENTION

An object of the invention is to provide an image forming apparatus capable of admitting air needed to achieve the cooling effect efficiently in a satisfactory manner without deteriorating the outward appearance.

An image forming apparatus in an aspect of the invention that achieves the above and other objects includes: an apparatus main body; a sheet feeding cassette attached to the apparatus main body so as to be pulled out to an outside; a cover that covers, with an internal space in between, a portion of the apparatus main body different from a portion where the sheet feeding cassette is attached; a handle portion formed on a front face side in a pull-out direction of the sheet feeding cassette so as to open for enabling a user to insert a fingertip therein; an air channel formed in the sheet cassette and allowing an opening of the handle portion and the internal space inside the cover to communicate with each other; and an air blower that sends outside air inside the apparatus main body by way of the opening, the air channel, and the internal space.

DETAILED DESCRIPTION OF THE PREFERRED EMBODIMENTS

Hereinafter, one embodiment of the invention will be described in detail with reference to the drawings.

(Schematic Configuration of Image Forming Apparatus)

Figure 1:
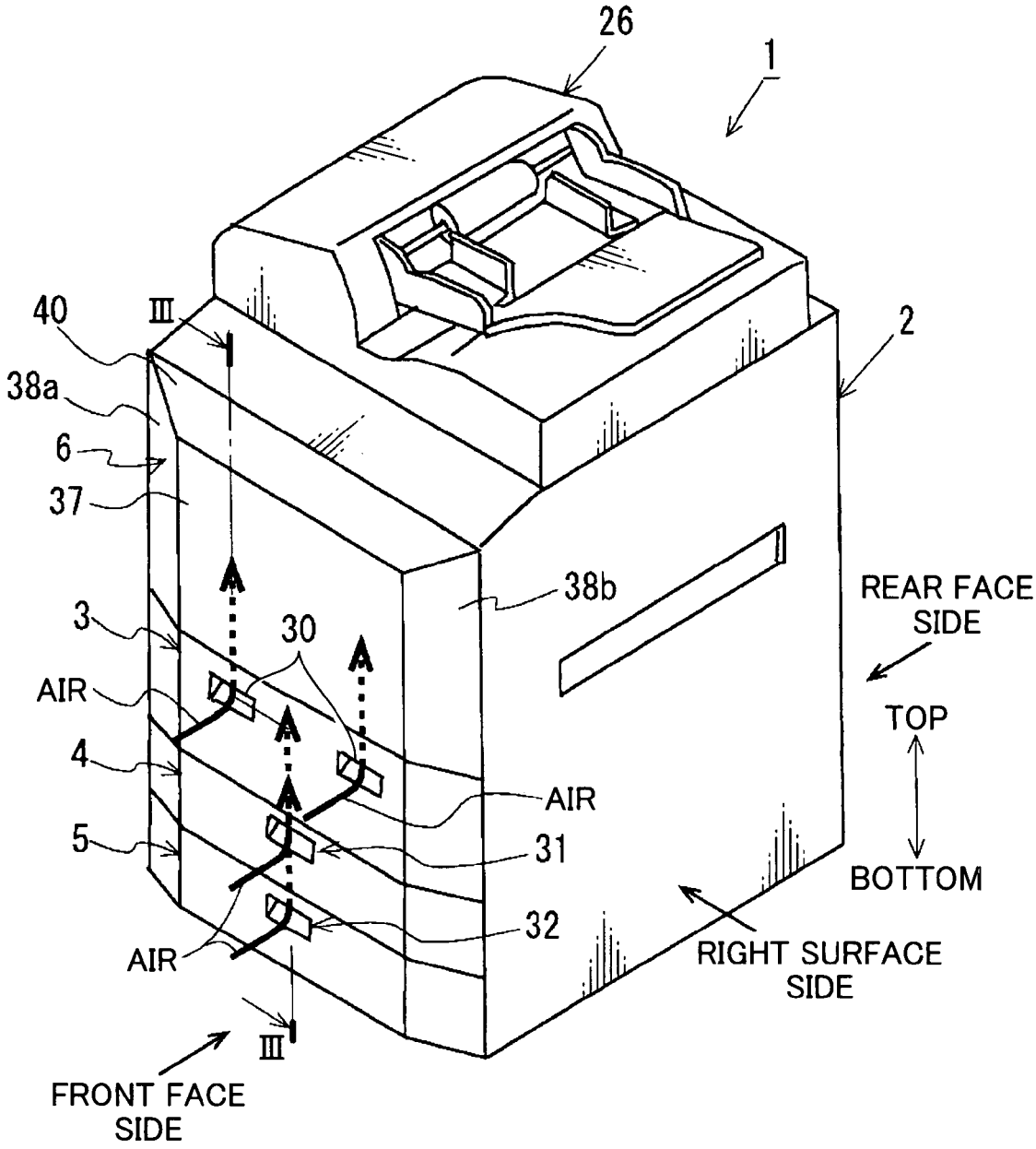
FIG. 1 is a perspective-view showing the outward appearance of an image forming apparatus according to one embodiment of the invention.
Figure 2:
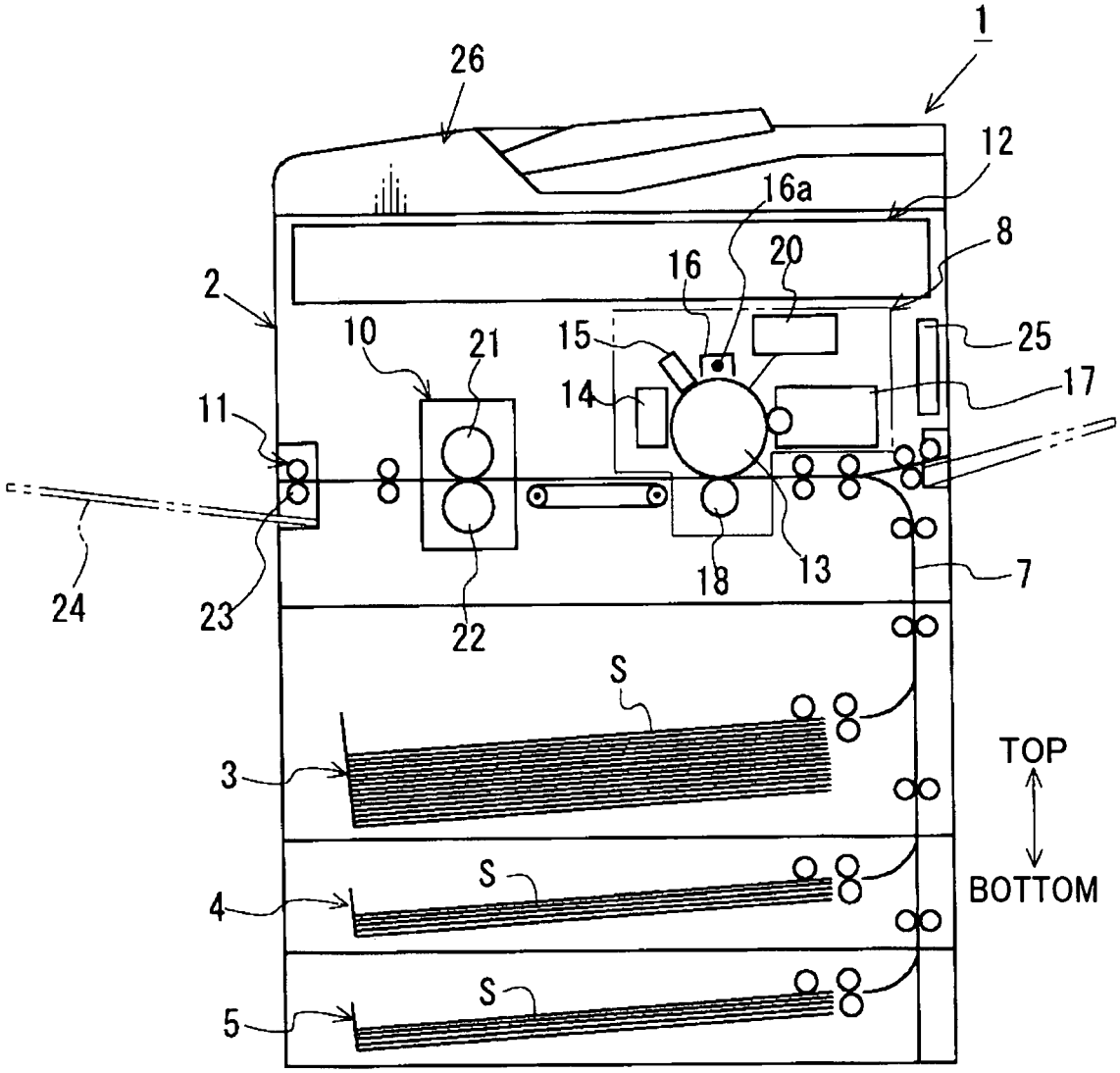
FIG. 2 is a cross section schematically showing the configuration of the image forming apparatus when viewed from the front face side.

FIG. 1 and FIG. 2 show an image forming apparatus 1 of this embodiment. FIG. 1 is a schematic perspective view showing the outward appearance of the image forming apparatus 1. FIG. 2 is a cross section schematically showing the configuration of the image forming apparatus 1 when viewed from the front face side.

The image forming apparatus 1 includes an apparatus main body 2 that accommodates various devices used for image formation. Sheet feeding cassettes 3, 4, and 5 adjacently aligned in the top-bottom direction in three stages are attached to the apparatus main body 2. These sheet feeding cassettes 3, 4, and 5 can be pulled out to the front face side from the respective accommodated positions in the apparatus main body 2, and the sheet feeding cassettes 3, 4, and 5 can be pulled out individually and independently.

A front cover 6 (cover) is attached to the apparatus main body 2 above the position where the sheet feeding cassette 3 in the uppermost stage is attached. The front cover 6 covers the front face side of the apparatus main body 2 positioned above the sheet feeding cassette 3 (the front face side of an engine room 72 shown in FIG. 4) with an internal space (a space 41 shown in FIG. 3) in between. The front cover 6 is attached to the apparatus main body 2 at the front face side in an openable and closable or removable manner.

Inside the apparatus main body 2 covered with the front cover 6, an image forming portion 8, a fixing device 10, and a sheet discharge portion 11 are provided sequentially from upstream to downstream of a sheet transportation path 7 (along the transportation direction of a recording material S). An image reading portion 12 is provided above the image forming portion 8 and the fixing device 10.

The image forming portion 8 transfers a toner image onto a recording material (a sheet of copy paper, an OHP film, and so forth) S fed from the sheet feeding cassette 3, 4, or 5 and transported along the sheet transportation path 7. The image forming portion 8 includes a photoconductive drum 13, and a cleaning device 14, a static eliminating device 15, a charging device 16, a developing device 17, and a transfer device 18, which are disposed sequentially on the periphery of the photoconductive drum 13 in a clockwise direction. The image forming portion 8 further includes an exposing device 20 provided in a space between the charging device 16 and the developing device 17.

In the image forming portion 8 configured as above, the surface of the photoconductive drum 13 is cleaned by the clearing device 14 (residual toner particles are removed) and the electricity is removed by the static eliminating device 15, after which the surface is charged to specific potential by the charging device 16. Subsequently, an electrostatic latent image is formed by irradiating light on the charged surface of the photoconductive drum 13 from the exposing device 20. A toner image is then formed by supplying toner particles from the developing device 17 to the surface of the photoconductive drum 13 on which the electrostatic latent image is formed. Subsequently, the toner image on the surface of the photoconductive drum 13 is transferred onto the surface of the recording material S by the transfer device 18, and the recording material S bearing thereon the transferred toner image is sent to the fixing device 10.

The fixing device 10 includes a heating mechanism (for example, a heating roller) 21 and a pressure mechanism (for example, a pressure roller) 22. The heating roller 21 and the pressure roller 22 heat and apply pressure to the recording sheet S bearing thereon the transferred toner image to fuse the toner image for fixing the toner image onto the recording sheet S, and send the recording sheet S bearing thereon the fixed toner image toward the sheet discharge portion 11.

The sheet discharge portion 11 is formed of a sheet discharge roller pair 23, and sends the recording material S sent from the fixing device 10 onto a sheet discharge tray 24 or into an unillustrated post-processing apparatus or the like.

A control portion 25 is provided inside the apparatus main body 2 covered with the front cover 6 at a position spaced apart from the fixing device 10 as a heat source and close to the image forming portion 8. The control portion 25 controls operations of the components, such as the image forming portion 8, the image reading portion 12, and the fixing device 10.

An automatic document feeding device 26 capable of automatically transporting documents to the reading position is attached on top of the apparatus main body 2.

The heater of the fixing device 10 and the motor of the exposing device 20 that will be the heat sources are provided inside the apparatus main body 2 described above. It is therefore necessary to prevent waste toner particles inside the cleaning device 14 and toner particles inside the developing device 17 from being fused by heat generated in the respective heat sources. It is also necessary to prevent a failure of electronics parts of the control portion 25 caused by heat generated in the respective heat sources.

Further, it is necessary to exhaust dust (fine toner particles or the like suspended in the air) and a gas generated in association with operations of the respective devices 14, 16, and 17 disposed on the periphery of the photoconductive drum 13 to the outside of the apparatus main body 2. In view of the foregoing, the image forming apparatus 1 of this embodiment is provided with a ventilation structure described in detail below to ventilate inside the apparatus main body 2 efficiently.

(Structure to Ventilate inside Apparatus Main Body)

Figure 3:
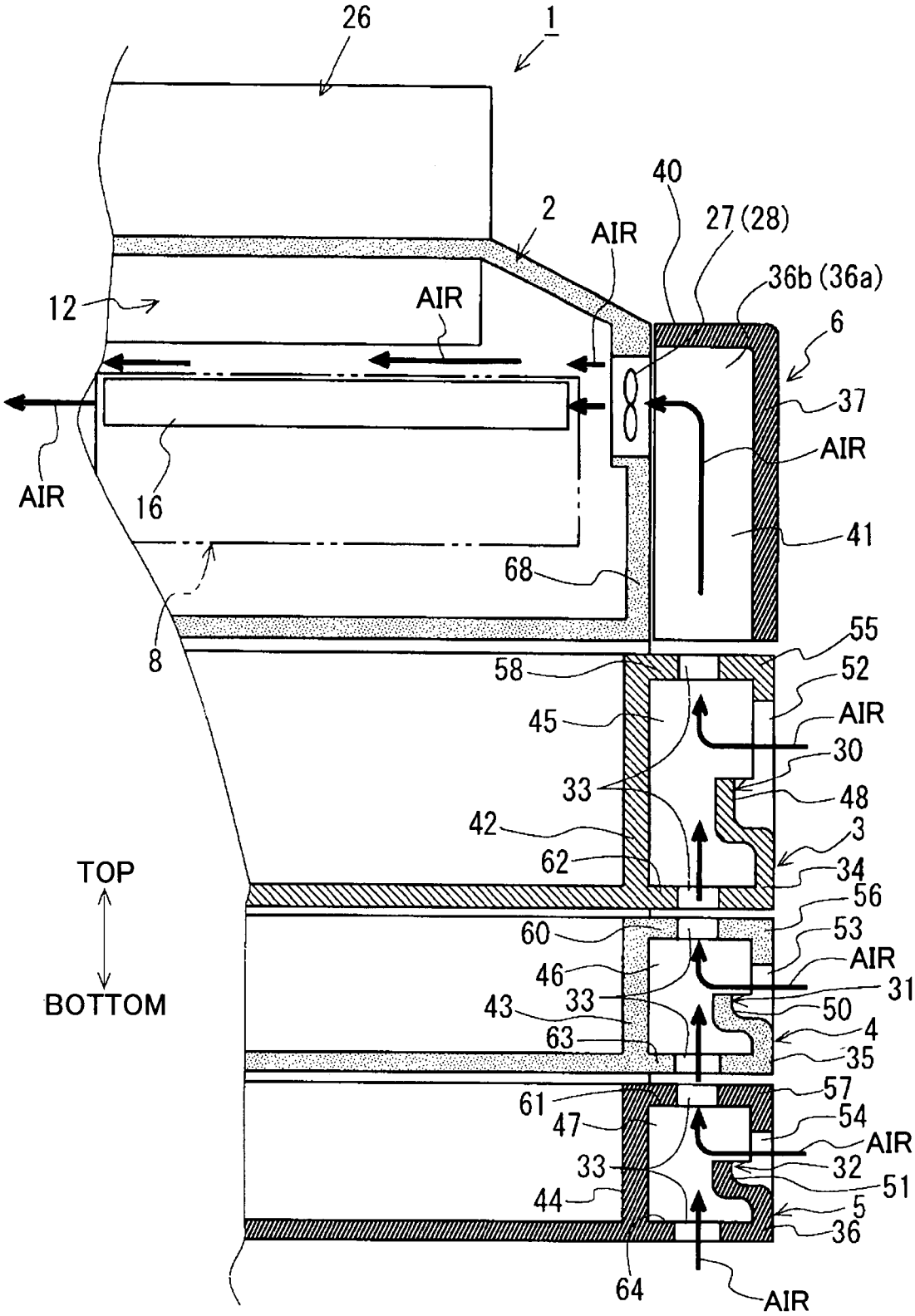
FIG. 3 is a cross section taken on line III-III of FIG. 1 from the front face side to the rear face side of the image forming apparatus.
Figure 4:
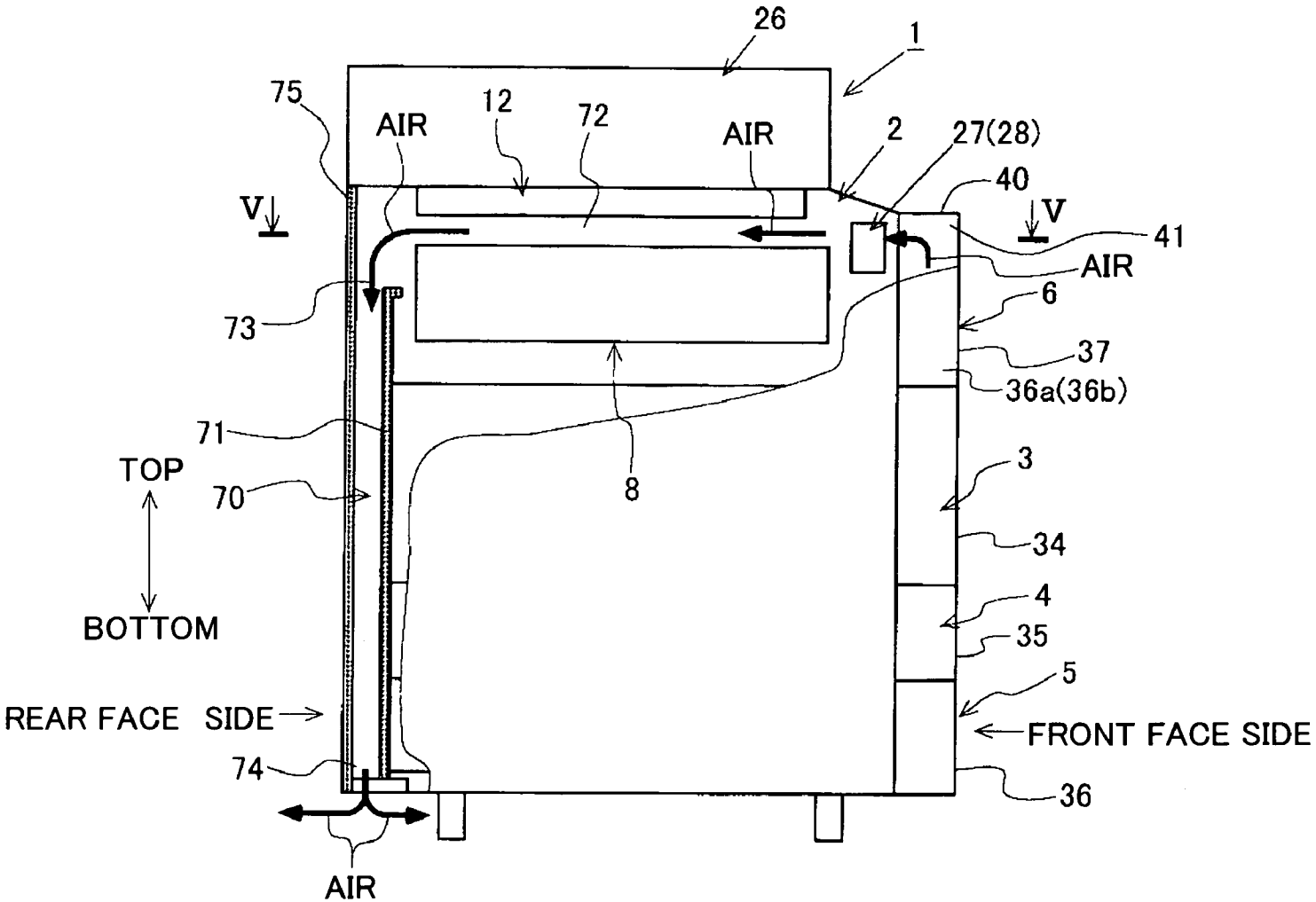
FIG. 4 is a view schematically showing a flow of air within an apparatus main body of the image forming apparatus.
Figure 5:
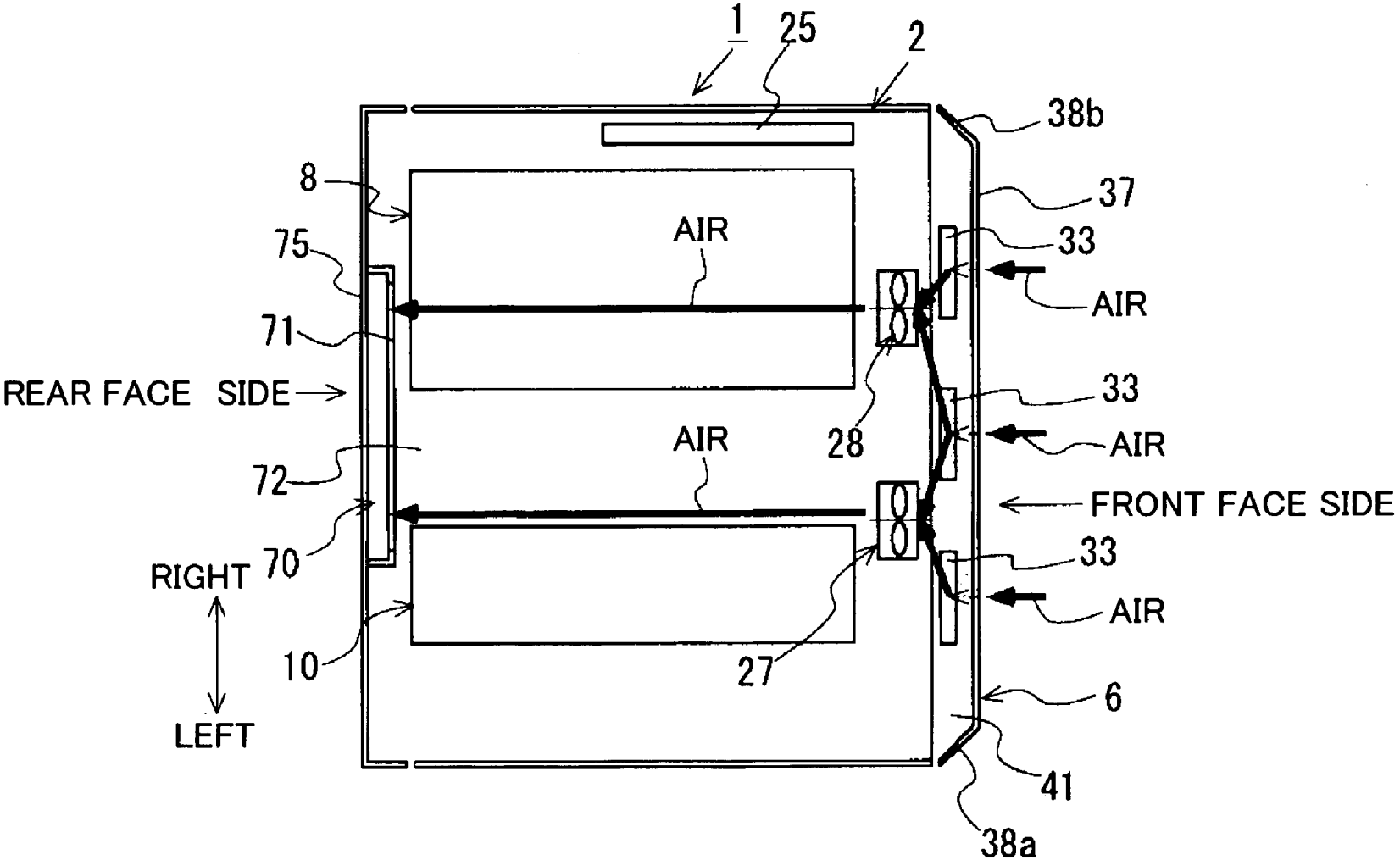
FIG. 5 is a schematic cross section taken on line V-V of FIG. 4.
Figure 6:
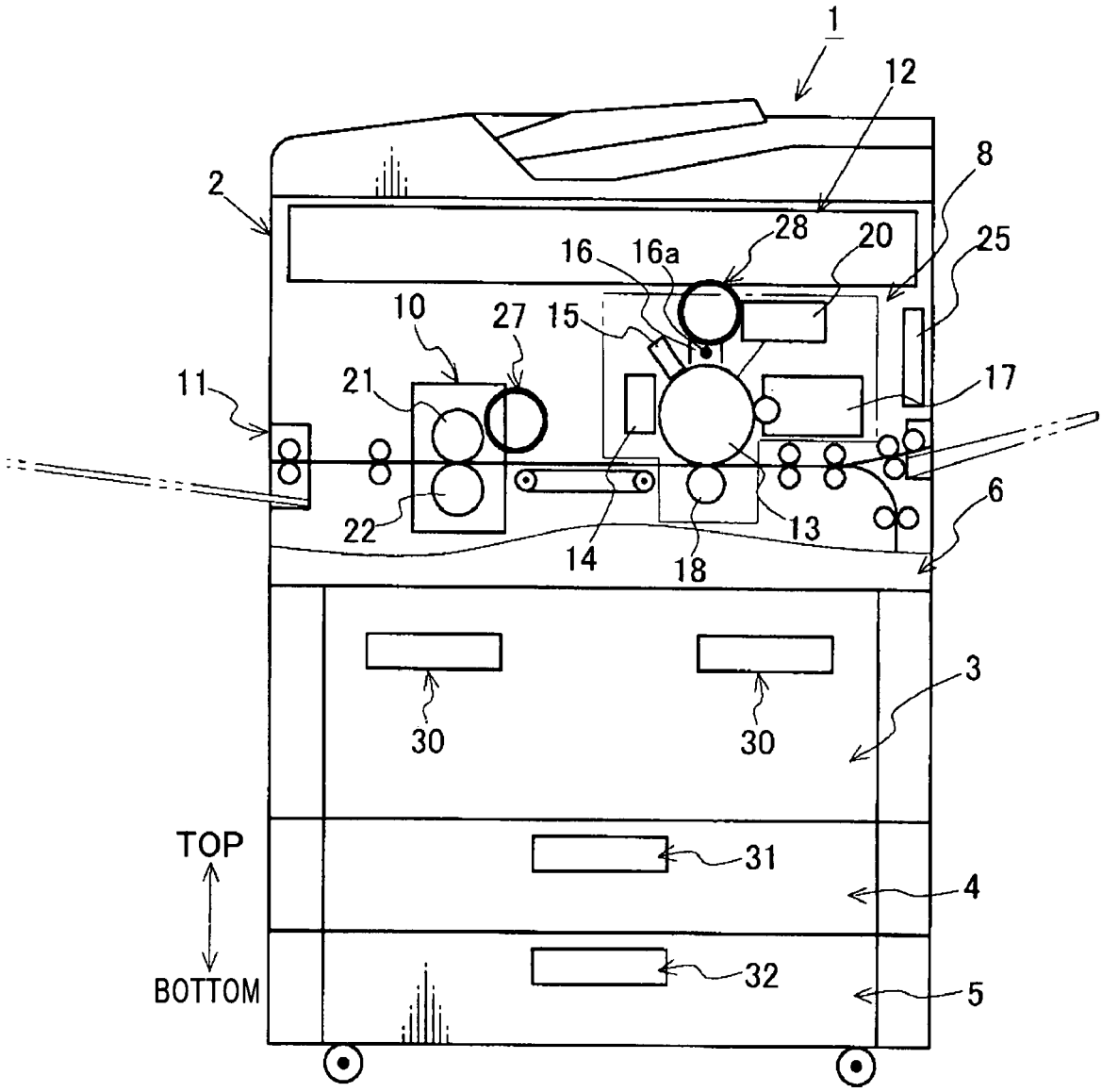
FIG. 6 is a view schematically showing the layout representing the positional relation between fans and other components.

FIG. 3 through FIG. 7D are views used to describe the ventilation structure of this embodiment. FIG. 3 is a cross section taken on line III-III of FIG. 1 from the front face side to the rear face side of the image forming apparatus 1. FIG. 4 is a view schematically showing a flow of air inside the apparatus main body 2 of the image forming apparatus 1. FIG. 5 is a cross section taken on line V-V of FIG. 4 to schematically show the structure inside the apparatus main body 2 and a flow of air inside the apparatus main body 2. Also, FIG. 6 is a view schematically showing the layout representing the positional relation between fans 27 and 28 as air blow means and other components when viewed from the front face side of the image forming apparatus 1. FIG. 7A through FIG. 7D are views (plan views) showing louvers 33 as an air inlet.

As are shown in FIG. 3 and FIG. 4, the image forming apparatus 1 is designed so that in a state where the sheet feeding cassettes 3, 4, and 5 are accommodated inside the apparatus main body 2, the front face side panels 34, 35, and 36 thereof and a front face side panel 37 of the front cover 6 are positioned on the same plane.

The font cover 6 includes a pair of side face panels 38*a*and 38*b* positioned oppositely to overhang from the apparatus main body 2 toward the front face, a top panel 40 connecting the both side face panels 38*a*and 38*b* at the top edges, the front face side panel 37 formed integrally with the both side faces 38*a*and 38*b* and the top panel 40 along the edges thereof (see FIG. 1 and FIG. 5). A space 41 (inner space) that opens toward the sheet feeding cassette 3 at the uppermost stage (downward) is defined between the front face side panel 37 of the front cover 6 and the apparatus main body 2. The space 41 has a volume large enough to be used as an air channel.

As is shown in FIG. 3, in the respective sheet feeding cassettes 3, 4, and 5, internal spaces 45, 46, and 47 (air channels) having volumes large enough not only for the user to insert more than one fingertip of his or her hand but also for use as air channels of admitted outside air are defined between the front face side panels 34, 35, and 36 (on the forward side in the pull-out direction of the sheet feeding cassettes) and internal partition walls 42, 43, and 44, respectively.

Concave handle portions 30, 31, and 32 are formed to the front face side panels 34, 35, and 36 (on the front face side in the pull-out direction) of the sheet feeding cassettes 3, 4, and 5, respectively, so that the user is able to hook more than one fingertip of his or her hand inserted therein with the palm facing up. The handle portions 30, 31, and 32 have, respectively, rising walls 48, 50, and 51 of a concave shape curved inward from the front face side panels 34, 35, and 36 so as to guide the fingertips, openings 52, 53, and 54 allowing more than one fingertip to be inserted into the spaces 45, 46, and 47, and opening top walls 55, 56, and 57 of the corresponding front face side panels to enable the user to hook more than one fingertip inserted through the opening 52, 53, or 54.

The sheet feeding cassettes 3, 4, and 5 are provided with louvers 33 that are made in top walls 58, 60 and 61 and in bottom walls 62, 63, and 64 connecting the front face side panels 34, 35, and 36 and the internal partition walls 42, 43, and 44, respectively. The louver 33 (first louver) made in the top wall 58 of the sheet feeding cassette 3 (first sheet feeding cassette) at the uppermost stage allows the space 45 serving as the air channel in the sheet feeding cassette 3 and the space 41 between the front cover 6 and the apparatus main body 2 to communicate with each other.

The positional relation between the louver 33 in the bottom wall 62 of the sheet feeding cassette 3 at the uppermost stage and the louver 33 (second louver) in the top wall 60 of the sheet feeding cassette 4 (second sheet feeding cassette) at the middle stage is set so that the former and the latter communicate with each other. Also, the positional relation between the louver 33 in the bottom wall 63 of the sheet feeding cassette 4 at the middle stage and the louver 33 in the top wall 61 of the sheet feeding cassette 5 at the bottommost stage is set so that the former and the latter communicate with each other. The louver 33 in the bottom wall 64 of the sheet feeding cassette 5 at the bottommost stage allows the outside environment (the outside of the sheet feeding cassette 5) and the space 47 to communicate with each other.

The configuration above allows the space 41 between the front cover 6 and the apparatus main body 2 to communicate with the external environment of the image forming apparatus 1 via the openings 52, 53, and 54 of the handle portions 30, 31, and 32, respectively, and the internal spaces 45, 46 and 47 of the handle portions 30, 31, and 32, respectively, in the sheet feeding cassettes 3, 4, and 5, respectively, and the respective louvers 33. For example, outside air introduced inside through the opening 52 of the handle portion 30 (first handle portion) at the uppermost stage is admitted into the space 41 inside the front cover 6 by way of the internal space 45 (first air channel). Meanwhile, outside air introduced inside through the opening 53 of the handle portion 31 (second handle portion) at the middle stage is admitted into the space 41 inside the front cover 6 from the internal space 46 (second air channel) by way of the internal space 45.

The sheet feeding cassettes 3, 4, and 5 have sheets of recording materials S, such as copy paper, stacked on the inner side of the internal partition walls 42, 43, and 44, respectively, and can be pulled out to the front face side of the image forming apparatus 1 along the rails (not shown) of the apparatus main body 2 when replenishing recording sheets S or removing jamming.

Figure 7A:
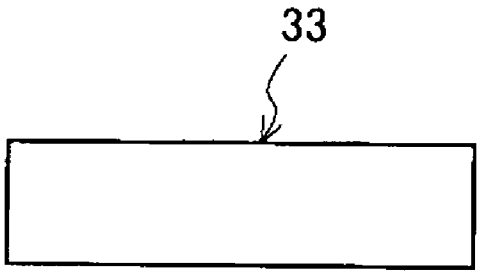
FIG. 7A through FIG. 7D are plan views showing examples of louvers.
Figure 7B:
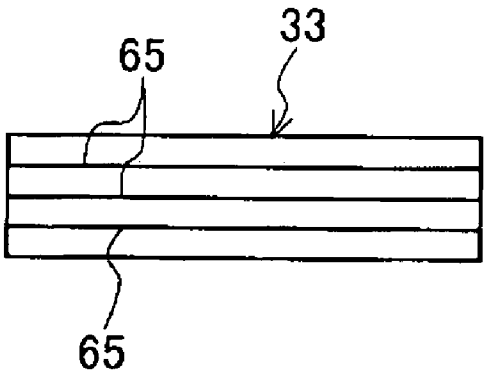
Figure 7C:
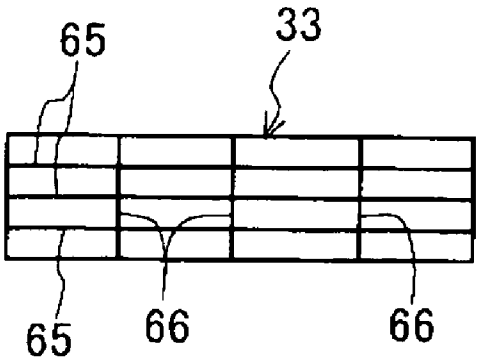
Figure 7D:
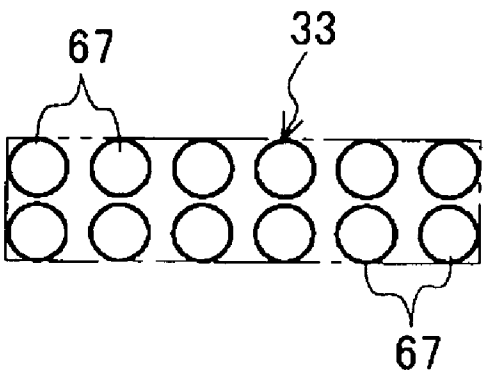

As is shown in FIG. 7A, the louvers 33 of the respective sheet feeding cassettes 3, 4, and 5 are formed to have a rectangular outside shape when viewed in a plane. FIG. 7B through FIG. 7D are plan views showing concrete shapes of the louvers 33. FIG. 7B shows a louver 33 in which the opening is divided into plural smaller openings by one-way slats 65. FIG. 7C shows a louver 33 in which the opening is divided into plural smaller openings by two-way slats 65 and 66 that are orthogonal to each other. FIG. 7D shows a louver 33 in which a large number of small-diameter circular holes 67 are arrayed.

Not only do the shapes of the louvers 33 shown in FIG. 7B through FIG. 7D enable sufficient air channels to be secured, but also they can prevent the fingertips of the user inserted into the handle portion 30, 31, or 32 from entering into the louvers 33. It should be noted that the louvers 33 of the respective sheet feeding cassettes 3, 4, and 5 are not necessarily of the same shape, and they may be of different shapes when the need arises. Alternatively, instead of providing louvers 33 having the slats 65 or 66 or circular holes 67, merely an air circulation hole of a rectangular shape as is shown in FIG. 7A may be provided at a position at which the louver 33 is installed.

The louvers 33 of the sheet feeding cassettes 3, 4, and 5 are formed in the top walls 58, 60 and 61 and in the bottom walls 62, 63, and 64 of the concave internal spaces 45, 46, and 47, respectively, and the sight of the user is interrupted by the opening top walls 55, 56, and 57 and the rising walls 48, 50, and 51. Hence, because the louvers 33 are hardly visually recognized by the user, the quality in outward appearance (beauty) of the image forming apparatus 1 will not be deteriorated.

In addition, in comparison with a case where air is admitted merely through fine clearances, such as clearances between the front cover 6 and the apparatus main body 2 as in the prior art, the louvers 33 of the respective sheet feeding cassettes 3, 4, and 5 are able to secure far larger areas of the air intake channels, which allows a sufficient amount of outside air to be admitted efficiently. It should be noted that air is admitted into the space 41 through fine clearances between the front cover 6 and the apparatus main body 2 in this embodiment, too.

As are shown in FIG. 3, FIG. 5, and FIG. 6, two fans 27 and 28 (air blowers) are attached to a frame 68 of the apparatus main body 2 on the front face side. These two fans 27 and 28 face the space 41 between the front cover 6 and the apparatus main body 2 so as to send air within the space 41 toward the rear face from the front face side within the apparatus main body 2. In other words, the fans 27 and 28 send outside air into the interior of the apparatus main body 2 by way of the openings 52, 53, and 54 and the internal spaces 45, 46, and 47 of the handle portions 30, 31, and 32, respectively, as well as the space 41.

The fan 28 blows (sends) a sufficient amount of air to the image forming portion 8 and the image forming portion 12 so as not only to cool the developing device 17, the cleaning device 14, and the exposing device 20 efficiently, but also to send out a gas containing silicon compounds that is generated on the periphery of a discharging wire 16*a* inside the charging device 16 and suspended matter (fine toner particles and dust) on the periphery of the photoconductive drum 13 to the outside of the apparatus main body 2 via an exhaust portion 70.

The other fan 27 chiefly blows (sends) a sufficient amount of air toward the fixing device 10 and the vicinity thereof so as not only to suppress transmission of heat from the fixing device 10 to the image forming portion 8 and the image reading portion 12 by cooling the fixing device 10 and the ambient temperature on the periphery thereof efficiently, but also to send out suspended matter on the periphery of the fixing device 10 to the outside of the apparatus main body 2 via the exhaust portion 70.

It is preferable to provide a filter (not shown) at a position on the space 41 side of the fans 27 and 28 to introduce air within the space 41 inside the apparatus main body 2 via the filter. When configured in this manner, dirt in the outside environment will not adhere to precision parts inside the apparatus main body 2. It is thus possible to effectively suppress defective image formation and a failure of precision parts (for example, parts forming components, such as the image forming portion 8, the image reading portion 12, and the control portion 25) that occur in association with introduction of outside air inside the apparatus main body 2.

The filter is disposed at the position on the space 41 side of the fans 27 and 28 in order to make it easier to replace the filter. However, in a case where the fans 27 and 28 can be readily removed from the apparatus main body 2, the filter may be disposed on the inner side of the apparatus main body 2 (the position on the side opposite to the space 41), which is the discharging side of the fans 27 and 28.

As are shown in FIG. 4 and FIG. 5, the exhaust portion 70 includes an exhaust duct 71 provided inside the apparatus main body 2 on the rear face side. The exhaust duct 71 is provided to guide an air flow sent from the front face side to the rear face side of the image forming apparatus 1 by the fans 27 and 28 to the bottom end from above on the rear face side within the apparatus main body 2, so that air is exhausted to the outside environment from the bottom face side of the apparatus main body 2. The exhaust duct 71 has an opening (upstream opening) 73 at one end that opens inside an engine room 72 in which components, such as the image forming portion 8 and the fixing device 10, are accommodated, and an opening (downstream opening) 74 at the other end that opens toward the outside environment on the bottom face side of the apparatus main body 2.

The exhaust portion 70 is not limited to the structure of the exhaust duct 71 described above. For example, louvers (not shown) may be provided to a rear face side panel 75 of the engine room 72, so that air inside the apparatus main body 2 is exhausted to the outside environment of the apparatus main body 2 via the louvers. Alternatively, the exhaust portion 70 may be provided with an exhaust fan (not shown) on the inner side of the opening 74 at the other end of the exhaust duct 71 or the louver in the rear face side panel 75 when the need arises, so that air inside the apparatus main body 2 is forcedly exhausted by the exhaust fan to achieve the increased exhaust efficiency.

Advantage of the Embodiment

The image forming apparatus 1 of this embodiment admits outside air into the apparatus main body 2 by utilizing the openings 52, 53, and 54 of the handle portions 30, 31, and 32, respectively, provided on the assumption that the user inserts his or her hand therein. Air necessary to achieve the cooling effect efficiently is thus admitted in a satisfactory manner. In addition, because the louvers 33 are provided on the inner side of the handle portions 30, 31, and 32 where they are hardly visually recognized by the user, outside air can be introduced sufficiently inside the apparatus main body 2 without deteriorating the quality in outward appearance.

Hence, not only is it possible to cool the heat sources (for example, the fixing device 10 and the exposing device 20) or the like efficiently, but it is also possible to send air efficiently for removing a gas containing silicon compounds generated inside the charging device 16 and matter (fine toner particles, dirt, and so forth) suspended in the ambient air on the periphery of the photoconductive drum 13 within the apparatus main body 2. In addition, because this embodiment is configured so as to provide the louvers 33 on the inner side of the handle portions 30, 31, and 32 of the sheet feeding cassettes 3, 4, and 5, respectively, there will be no restriction on the installment associated with the position where the louvers are provided as was in the prior art.

(First Modification)

Figure 8:
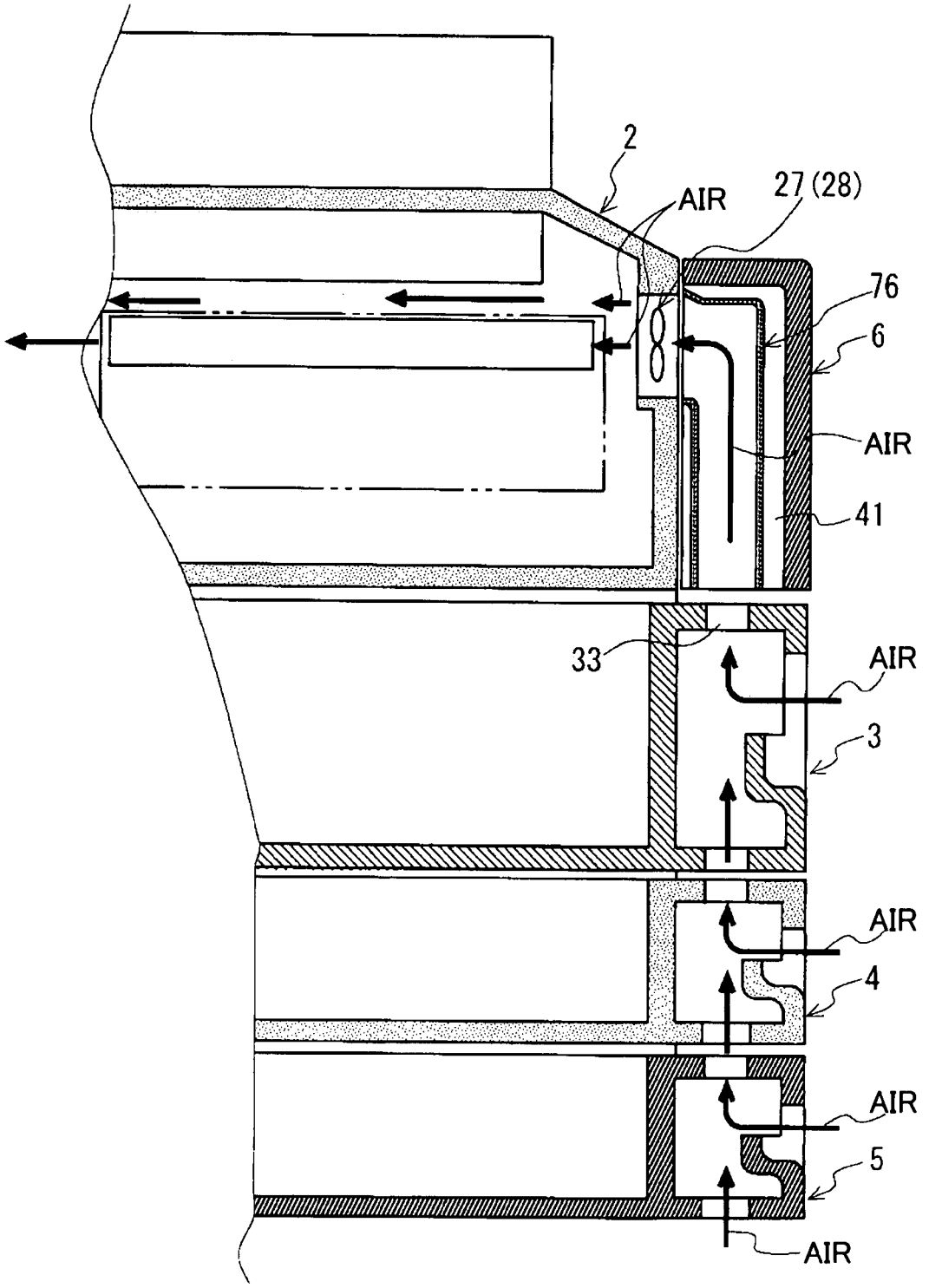
FIG. 8 is a view showing a first modification of the image forming apparatus according to the embodiment of the invention and corresponding to FIG. 3.
Figure 9:
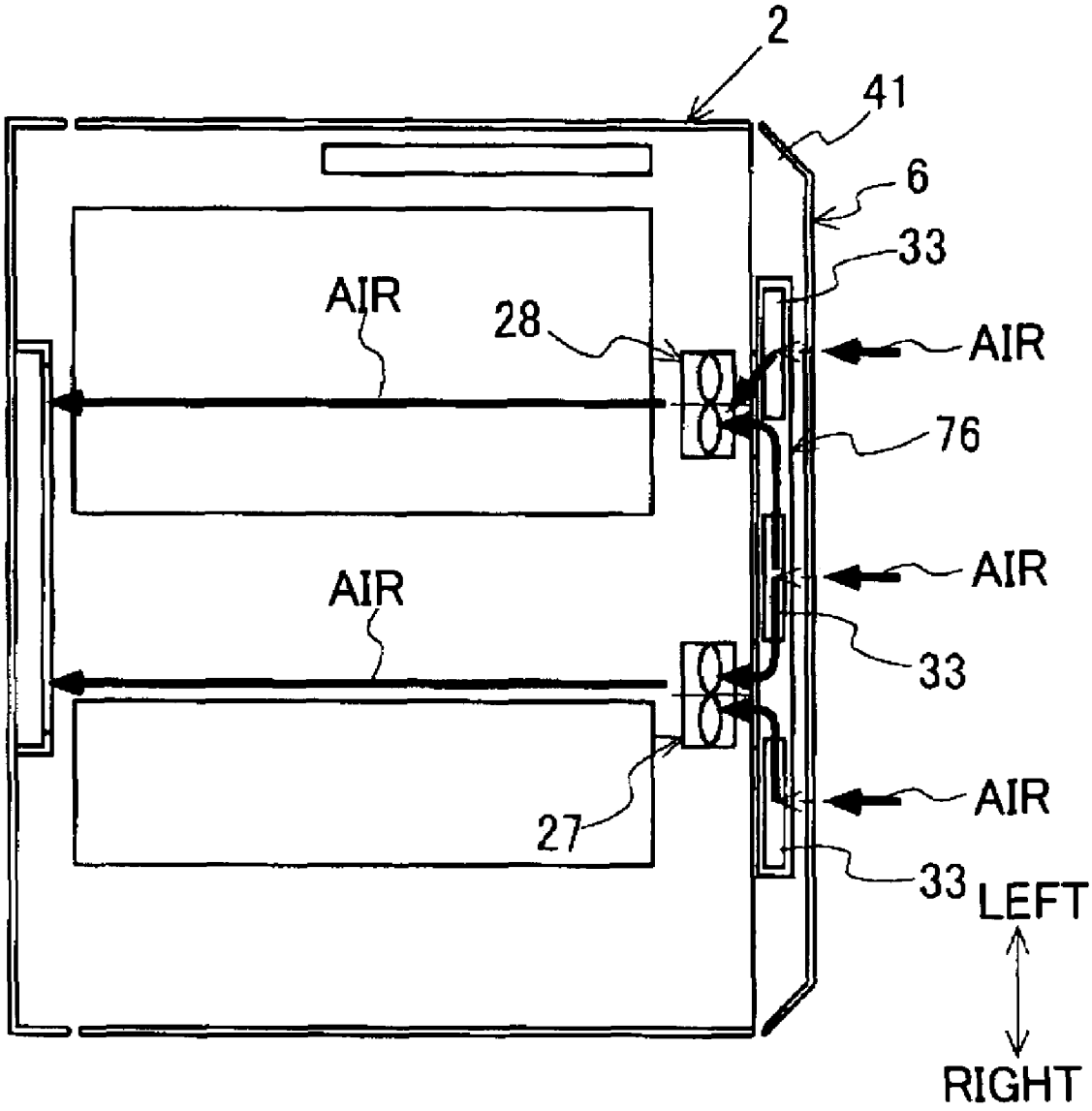
FIG. 9 is a view showing the first modification and corresponding to FIG. 5.

FIG. 8 and FIG. 9 show a first modification of the embodiment above. FIG. 8 corresponds to FIG. 3 and FIG. 9 corresponds to FIG. 5.

In the first modification, an air intake duct 76 is provided within the space 41 between the apparatus main body 2 and the front cover 6. The air intake duct 76 communicates with the louvers 33 in the top wall of the sheet feeding cassette 3 at the uppermost stage. Air introduced inside via the louvers 33 is guided efficiently to the vicinity of the fans 27 and 28 by the air intake duct 76.

When configured in this manner, even under unfavorable conditions that toner particles or the like are suspended in the atmosphere within the space 41 on the inner side of the front cover 6, it is still possible to suppress an inconvenience that suspended matter, such as the toner particles, suspended within the space 41 is blown onto the components, such as the image forming portion 8 and the image reading portion 12, by the fans 27 and 28.

(Second Modification)

Figure 10:
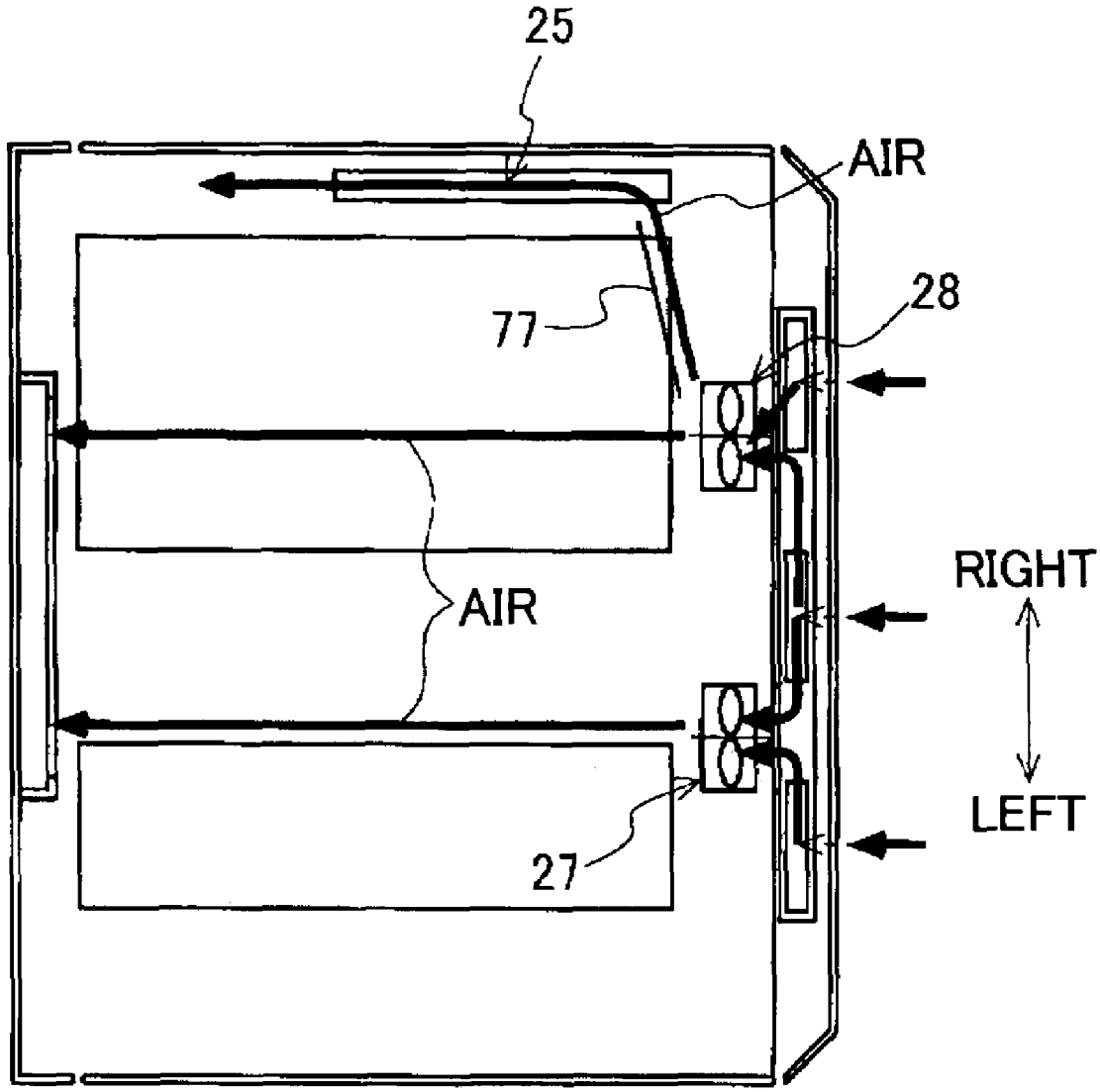
FIG. 10 is a view showing a second modification and corresponding to FIG. 5.
Figure 11:
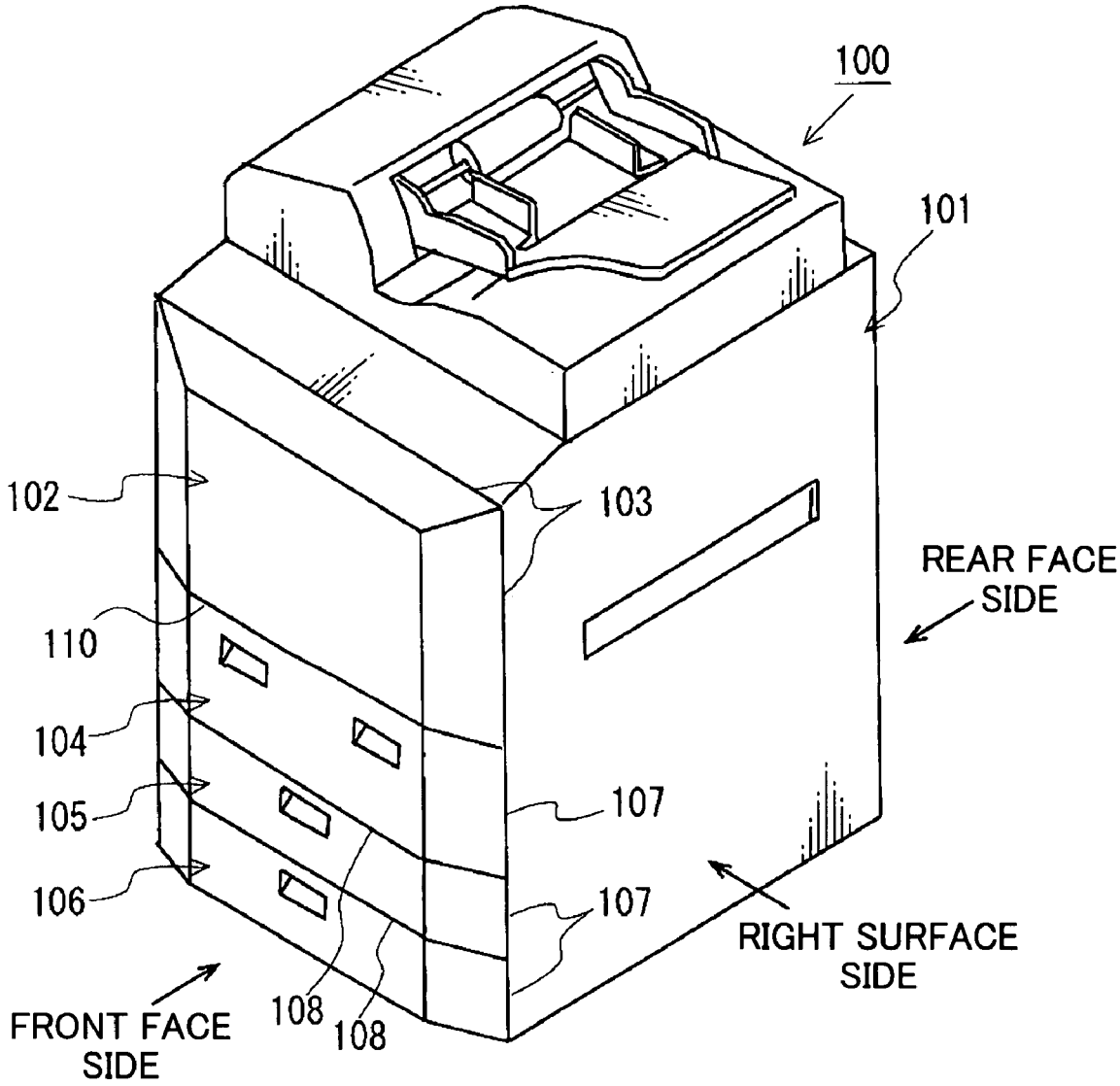
PRIOR ART FIG.11
FIG. 11 is a perspective view showing the outward appearance of a conventional image forming apparatus.

FIG. 10 shows a second modification of the embodiment above, and corresponds to FIG. 5. The second modification is configured to be provided with a guide plate 77 that guides a partial portion of an air flow sent from the fan 28 toward the control portion 25 so that the control portion 25 is forcedly cooled by the air flow guided by the guide plate 77.

According to the modification configured as above, it is possible to efficiently forestall a failure of the control portion 25 caused by influences of heat. As the guide plate 77, a part may be additionally provided inside the engine room 72 separately from the image forming portion 8 and the like or it may be formed of an exterior panel of parts forming the image forming portion 8, a frame forming a part of the apparatus main body, and so forth.

(Third Modification)

In each of the embodiment above and the respective modifications above, it may be configured in such a manner that, the louver 33 in the middle out of the three louvers 33 (FIG. 5) of the sheet feeding cassette 3, which open to the space 41 between the apparatus main body 2 and the front cover 6, is omitted, and the louvers 33 on the left and the right are connected to the corresponding louvers 33 of the sheet feeding cassettes 4 and 5 in the lower stages.

(Other Modifications)

The embodiment above is configured in such a manner that the respective sheet feeding cassettes 3, 4, and 5 are pulled out to the front face side of the apparatus main body 2. Instead of this configuration, it may be configured in such a manner that the respective sheet feeding cassettes 3, 4, and 5 are pulled out to the side face of the apparatus main body 2 and the portion above the sheet feeding cassette 3 at the uppermost stage of the image forming apparatus 2 is covered with a side cover. Herein, the relation between the side cover and the respective sheet feeding cassettes 3, 4, and 5 is set so as to correspond to the relation between the front cover 6 and the respective sheet feeding cassettes 3, 4, and 5 in the embodiment above.

In addition, the embodiment above has described a case where two fans 27 and 28 are used by way of example. However, air may be sent inside the apparatus main body 2 using a single fan, or air may be sent inside the apparatus main body 2 using three or more fans.

INDUSTRIAL APPLICABILITY

The invention is not limited to an electrophotographic image forming apparatus, and is also applicable to an ink jet image forming apparatus equipped with a heat generating portion and a control portion that hates heat.

The specific embodiment described above chiefly includes inventions having the following configurations.

An image forming apparatus according to an aspect of the invention includes: an apparatus main body; a sheet feeding cassette attached to the apparatus main body so as to be pulled out to an outside; a cover that covers, with an internal space in between, a portion of the apparatus main body different from a portion where the sheet feeding cassette is attached; a handle portion formed on a front face side in a pull-out direction of the sheet feeding cassette so as to open for enabling a user to insert a fingertip therein; an air channel formed in the sheet cassette and allowing an opening of the handle portion and the internal space inside the cover to communicate with each other; and an air blower that sends outside air inside the apparatus main body by way of the opening, the air channel, and the internal space.

According to this configuration, because outside air is admitted inside the apparatus main body by utilizing the opening of the handle portion provided on the assumption that the user inserts his or her hand therein, air necessary to achieve the cooling effect efficiently can be admitted in a satisfactory manner. Hence, not only is it possible to cool the heat sources inside the apparatus main body (for example, the fixing device and the exposing device) or the like efficiently, but it is also possible to send air efficiently for removing matter (fine toner particles, dirt, and so forth) suspended within the apparatus main body.

In the configuration described above, it is preferable to further include a louver disposed at a specific position in the air channel. In this case, it is more preferable that the louver is disposed at a position so as to be hardly visually recognized from an outside.

According to this configuration, because the louver is hardly visually recognized by the user, it is possible to introduce outside air inside the apparatus main body sufficiently without deteriorating the quality in outward appearance. In addition, because the louver is provided on the inner side of the sheet feeding cassette, there will be no restriction on the installment associated with the position where the louver is provided as was in the prior art.

In the configurations described above, it may be configured in such a manner that the cover is disposed above the sheet feeding cassette; the air channel is a space partitioned by plural walls and defined on a forward side of the pull-out direction of the sheet feeding cassette; the handle portion is an opening provided in a wall positioned on the front face side of the pull-out direction of the sheet feeding cassette among the plural walls for enabling the user to hook more than one fingertip of his or her hand inserted therein with a palm facing up; and the louver is provided in a top wall opposing the internal space inside the cover among the plural walls.

According to this configuration, it is possible to prevent the fingertips of the user inserted into the handle portion of the sheet feeding cassette that can be pulled out from entering into the louver (going beyond the louver).

In the configurations described above, it may be configured in such a manner that a first sheet feeding cassette and a second sheet feeding cassette attached to the apparatus main body so as to be adjacent to each other are further included; the first sheet feeding cassette has a first handle portion and a first air channel; the second sheet feeding cassette has a second handle portion and a second air channel; outside air introduced through an opening of the first handling portion is admitted into the internal space inside the cover by way of the first air channel; and outside air introduced through an opening of the second handle portion is admitted into the internal space inside the cover from the second air channel by way of the first air channel.

According to this configuration, even when there is more than one sheet feeding cassette, outside air can be admitted inside by using the openings of the respective handle portions.

In this case, it is preferable that the first and second sheet feeding cassettes are attached to the apparatus main body side by side in a top-bottom direction; the cover is disposed above the first and second sheet feeding cassettes; each of the first and second air channels is a space partitioned by plural walls and defined on a forward side of a pull-out direction of the first and second sheet feeding cassettes; each of the first and second handle portions is an opening provided to a wall positioned on a front face side of the pull-out direction of the first and second sheet feeding cassettes among the plural walls for enabling the user to hook more than one fingertip of his or her hand inserted therein with a palm facing up; a first louver is provided to a top wall opposing the internal space inside the cover among the plural walls forming the first air channel; and a second lover is provided to a top wall opposing the first air channel among the plural walls forming the second air channel.

According to this configuration, it is possible to prevent the fingertips of the user inserted into the handle portion of either the first sheet feeding cassette or the second sheet feeding cassette that can be pulled out from entering into the first or second louver (going beyond the corresponding louver).

In the configurations described above, it is preferable to further include an air intake duct disposed within the internal space inside the cover to guide air introduced from the air channel to a vicinity of the air blower.

According to this configuration, outside air introduced from the air channel is guided to the vicinity of the air blower efficiently by the air intake duct. In addition, even under the circumstances that suspended matter, such as toner particles, is suspended within the internal space inside the cover, it is possible not to send air containing the suspended matter inside the apparatus main body.

In the configurations described above, it is preferable to further include a filter disposed in close proximity to the air blower for filtered outside air to be sent inside the apparatus main body.

According to this configuration, it is possible to avoid an inconvenience that dirt in the outside environment adheres onto the precision parts inside the apparatus main body.

This application is based on patent application No. 2006-228606 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body;

a sheet feeding cassette attached to the apparatus main body so as to be pulled out to an outside;

a cover that covers, with an internal space in between, a portion of the apparatus main body different from a portion where the sheet feeding cassette is attached;

a handle portion formed on a front face side in a pull-out direction of the sheet feeding cassette so as to open for enabling a user to insert a fingertip therein;

an air channel formed in the sheet cassette and allowing an opening of the handle portion and the internal space inside the cover to communicate with each other; and an air blower that sends outside air inside the apparatus main body by way of the opening, the air channel, and the internal space.

2. The image forming apparatus according to claim 1, further comprising:

a louver disposed at a specific position in the air channel.

3. The image forming apparatus according to claim 2, wherein:

the louver is disposed at a position so as to be hardly visually recognized from an outside.

4. The image forming apparatus according to claim 3, wherein:

the cover is disposed above the sheet feeding cassette the air channel is a space partitioned by plural walls and defined on a forward side of the pull-out direction of the sheet feeding cassette;

the handle portion is an opening provided in a wall positioned on the front face side of the pull-out direction of the sheet feeding cassette among the plural walls for enabling the user to hook more than one fingertip of his or her hand inserted therein with a palm facing up; and the louver is provided in a top wall opposing the internal space inside the cover among the plural walls.

5. The image forming apparatus according to claim 1, further comprising:

a first sheet feeding cassette and a second sheet feeding cassette attached to the apparatus main body so as to be adjacent to each other, wherein:

the first sheet feeding cassette has a first handle portion and a first air channel;

the second sheet feeding cassette has a second handle portion and a second air channel;

outside air introduced through an opening of the first handling portion is admitted into the internal space inside the cover by way of the first air channel; and outside air introduced through an opening of the second handle portion is admitted into the internal space inside the cover from the second air channel by way of the first air channel.

6. The image forming apparatus according to claim 5, wherein:

the first and second sheet feeding cassettes are attached to the apparatus main body side by side in a top-bottom direction;

the cover is disposed above the first and second sheet feeding cassettes;

each of the first and second air channels is a space partitioned by plural walls and defined on a forward side of a pull-out direction of the first and second sheet feeding cassettes;

each of the first and second handle portions is an opening provided to a wall positioned on a front face side of the pull-out direction of the first and second sheet feeding cassettes among the plural walls for enabling the user to hook more than one fingertip of his or her hand inserted therein with a palm facing up;

a first louver is provided to a top wall opposing the internal space inside the cover among the plural walls forming the first air channel; and a second lover is provided to a top wall opposing the first air channel among the plural walls forming the second air channel.

7. The image forming apparatus according to claim 1, further comprising:

an air intake duct disposed within the internal space inside the cover to guide air introduced from the air channel to a vicinity of the air blower.

8. The image forming apparatus according to claim 1, further comprising:

a filter disposed in close proximity to the air blower for filtering outside air to be sent inside the apparatus main body.

* * * * *